US006618999B1

(12) United States Patent
Reynolds

(10) Patent No.: US 6,618,999 B1
(45) Date of Patent: Sep. 16, 2003

(54) CROWN BUMPER

(75) Inventor: Michael Joe Reynolds, Wichita Falls, TX (US)

(73) Assignee: JM Clipper Corporation, Houston, TX (US)

( * ) Notice: Subject to any disclaimer, the term of this patent is extended or adjusted under 35 U.S.C. 154(b) by 0 days.

(21) Appl. No.: 09/971,261

(22) Filed: Oct. 4, 2001

(51) Int. Cl.[7] ..... B66C 23/06

(52) U.S. Cl. ..... 52/120; 52/111; 52/651.05; 212/281

(58) Field of Search ..... 52/120, 111, 651.05; 212/281

(56) References Cited

U.S. PATENT DOCUMENTS

| | | | | | |
|---|---|---|---|---|---|
| 3,805,902 | A | * | 4/1974 | Storm et al. | 175/85 |
| 4,469,171 | A | * | 9/1984 | Mine | 166/85.5 |
| 4,796,863 | A | | 1/1989 | Reed | 254/337 |
| 4,831,795 | A | | 5/1989 | Sorokan | 52/120 |
| 4,903,443 | A | | 2/1990 | Reed | 52/120 |
| 5,838,246 | A | * | 11/1998 | Voorhees | 340/685 |
| 5,921,329 | A | * | 7/1999 | Armstrong | 175/57 |

* cited by examiner

*Primary Examiner*—Carl D. Friedman
*Assistant Examiner*—Steve Varner
(74) *Attorney, Agent, or Firm*—Buskop Law Group, P.C.; Wendy Buskop

(57) ABSTRACT

A safety apparatus for a lifting structure having a crown and at least one traveling block, and an oil derrick having a crown bumper, wherein the safety apparatus comprises at least two support beams attached to crown of the lifting structure; a plate secured between the support beams; a bumper pad secured to the plate and adapted to be positioned at the crown of the lifting structure to cushion any impact with the traveling block if the traveling block is lifted towards the crown without stopping and the oil drilling rig apparatus, comprises: a derrick having a lower end for mounting on a platform, an upwardly projecting frame, and an upper, crown end; a traveling block suspended from the upper crown end within the derrick frame; drive means linked to the traveling block for driving the traveling block up and down the frame in a predetermined travel path; and a crown bumper comprising: at least two support beams attached to the derrick; a plate secured between said support beams; a bumper pad secured to the plate and adapted to be positioned at the crown end of the derrick to cushion any impact with the traveling block if it is pulled to the crown end without stopping, and a crown bumper and method of use.

31 Claims, 2 Drawing Sheets

CROWN BUMPER

BACKGROUND OF THE INVENTION

The present invention relates generally to safety devices primarily for use on oil drilling derricks on oil platforms or rigs, and is particularly concerned with apparatus when a traveling block approaches the top or crown block of a hoisting assembly on a drilling derrick or a hoisting unit.

Oil drilling derricks typically have hoisting equipment including a crown block at the top of the derrick and a traveling block which is linked to the crown block via a cable and pulley or sheave arrangement, and which travels up and down the derrick by means of a suitable hydraulic drive or the like Because of the large size and weight of the traveling block, the pulleys or sheaves in the crown and traveling block are liable to be damaged if the traveling block travels up far enough to strike the crown block. Additionally, debris as a result of such an impact may fall and possibly injure workers on the platform below. A number of devices have been used in the past to attempt to avoid such problems, but these are subject to various disadvantages.

Typically, to avoid the traveling block striking the crown block, a pair of wooden studs or rails is bolted across the derrick below the crown block, so that the traveling block strikes these rails before it reaches the crown block. However, these have a tendency to be crushed or separated from the derrick on impact, and often fall to the floor or platform, potentially injuring personnel.

Prior art which is incorporated by reference herein includes U.S. Pat. No. 5,838,246 for a safety device for a derrick with an alarm mechanism and related drilling derrick assemblies, such as U.S. Pat. No. 4,831,795, a dual cluster crown block as in U.S. Pat. No. 4,796,863, and a derrick with upper and lower crown blocks as in U.S. Pat. No. 4,903,443.

SUMMARY OF THE INVENTION

The present invention relates to a safety apparatus for a lifting structure having a crown and at least one traveling block, comprising: at least two support beams attached to crown of the lifting structure; a plate secured between the support beams; a bumper pad secured to the plate and adapted to be positioned at the crown of the lifting structure to cushion any impact with the traveling block if the traveling block is lifted towards the crown without stopping.

The invention also relates to an oil drilling rig apparatus, comprising: a derrick having a lower end for mounting on a platform, an upwardly projecting frame, and an upper, crown end; a traveling block suspended from the upper crown end within the derrick frame; drive means linked to the traveling block for driving the traveling block up and down the frame in a predetermined travel path; and a crown bumper comprising: at least two support beams attached to the derrick; a plate secured between said support beams; a bumper pad secured to the plate and adapted to be positioned at the crown end of the derrick to cushion any impact with the traveling block if it is pulled to the crown end without stopping.

The invention also relates to a method of preventing damage to the crown of a derrick at an oil drilling derrick prior to impact of a traveling block with a crown end of the derrick, comprising the steps of: securing a crown bumper at a location spaced below the crown end in a travel path of the traveling block at that location comprising support beams secured to said crown end, a plate secured to said support beams and a bumper pad secured to said plate; driving the traveling block up the derrick until just before it contacts the bumper pad; and applying the brakes to stop the traveling block.

BRIEF DESCRIPTION OF THE DRAWINGS

The present invention will be better understood from the following detailed description of a preferred embodiment of the invention, taken in conjunction with the accompanying drawings, in which like reference numerals have been used for like parts, and in which.

DESCRIPTION OF THE PREFERRED EMBODIMENT

The present invention relates to a safety apparatus for a lifting structure having a crown and at least one traveling block, comprising: at least two support beams attached to crown of the lifting structure; a plate secured between the support beams; a bumper pad secured to the plate and adapted to be positioned at the crown of the lifting structure to cushion any impact with the traveling block if the traveling block is lifted towards the crown without stopping.

Figure 1:
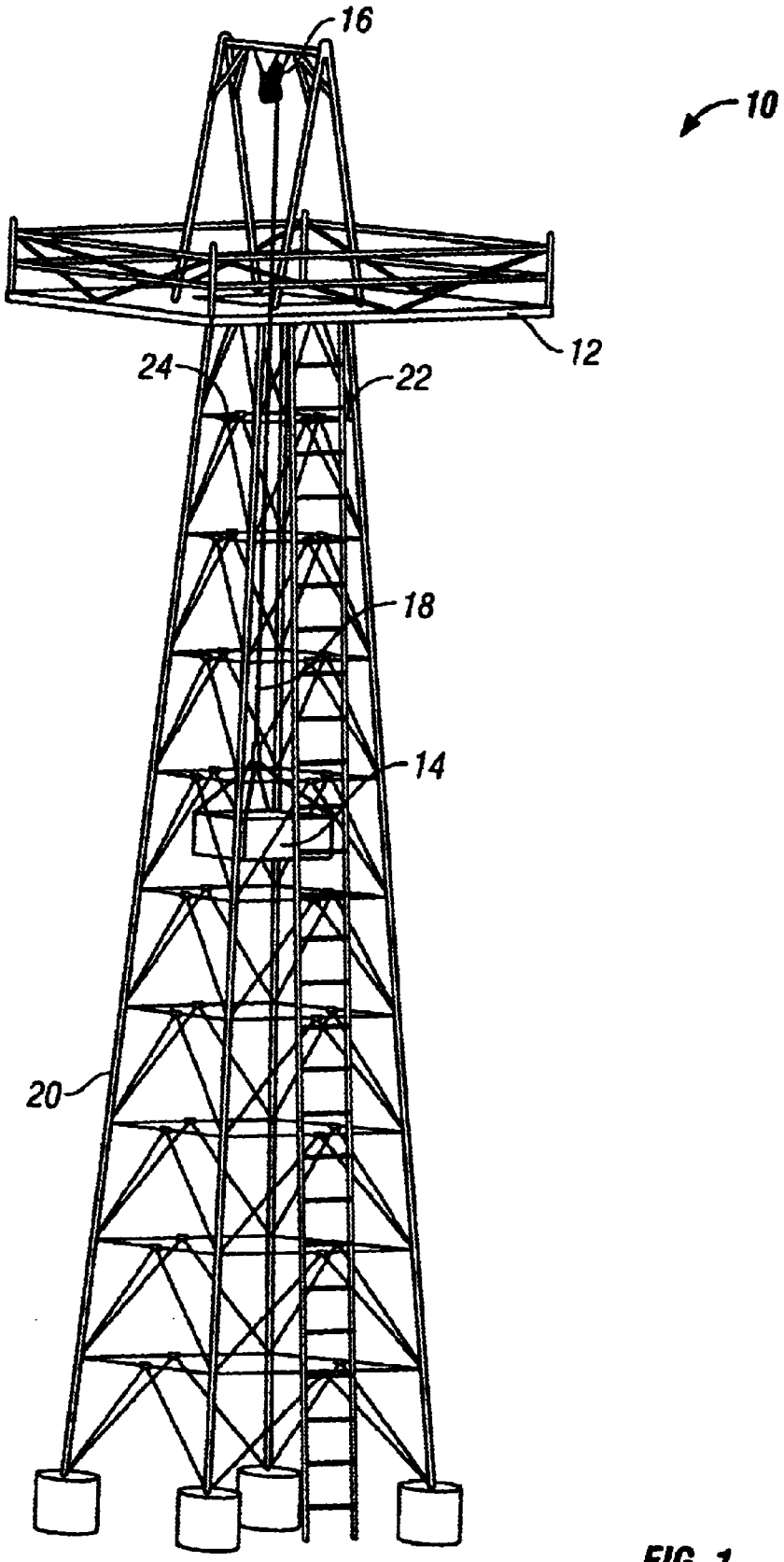
FIG. 1 is a front view of a typical derrick.

FIG. 1 illustrates a typical oil drilling derrick 10 on which a safety apparatus according to a preferred embodiment of the present invention has been installed. The safety apparatus is referred to herein as the crown bumper, which comprises two support beams, a plate and a bumper pad.

Although the safety apparatus is described in the preferred embodiment for use on an oil drilling derrick, it-may also be used on other types of hoisting equipment such as hoisting cranes and hoist units for mine shafts and the like.

As is known in the field, and shown in FIG. 1, a typical oil drilling derrick 10 has an upper end 12 on which a traveling block 14 carrying a stack of sheaves or pulleys 16 is mounted. Traveling block 14 is suspended from the crown end of the derrick via cables 18 which extend around the pulleys 16. The derrick 10 itself is a vertical framework of upwardly extending bars or struts 20 and crossbars 22. A suitable drive unit (not illustrated) is provided for driving the traveling block up and down the derrick. It is well known in the field that damage and potential injuries may result if the traveling block is allowed to travel up the derrick until it impacts the top of the derrick. This invention prevents damage which occurs with present devices, where rail road ties are installed on the crown and then are broken and pieces fall on the workers of the rig.

The safety apparatus of this invention may be installed in any conventional drilling derrick, to cushion the traveling block when it hits the top of the derrick.

Figure 2:
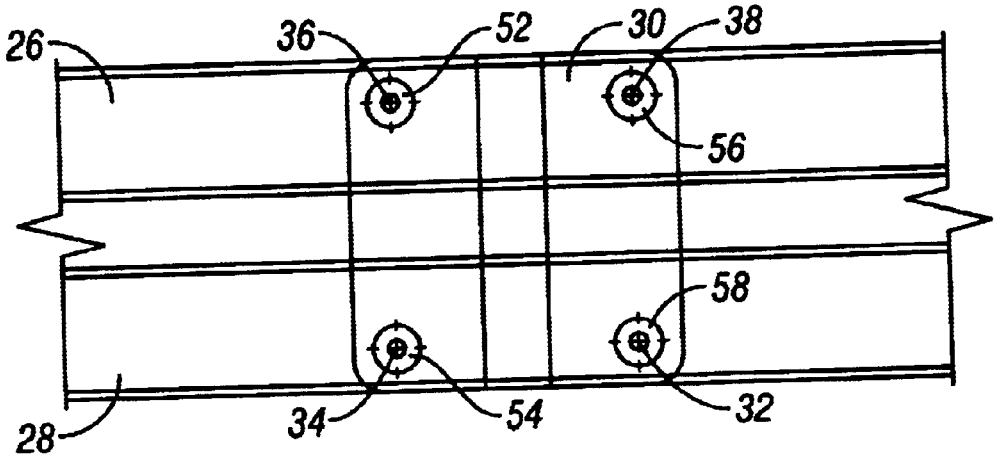
FIG. 2 is a top view of the crown bumper of the invention.

FIG. 2 shows a crown bumper 24 which basically comprises a first steel support 26, a second steel support 28 secured to the upper end of the derrick or other lifting structure. The supports can be made from any low temperature rated metal, such as steel, heat-treated steel, coated steel or the like.

The support beams preferably have a thickness of at least 1 inch and a width of at least 2 inches, and a length of between 30 to 60 inches. In the most preferred embodiment, the two support beams are made of structural steel, with each support beam having a length of 58 inches, a width of 3 inches and a thickness of 1 inch.

It is considered within the scope of the invention, that instead of two support beams, a single plate could be installed on the derrick, or at the top of the hoist if another type of lifting device is used, to which the remaining components of the crown bumper are secured.

In the most preferred embodiment, a plate 30 is secured to the supports 26 and 28 with fasteners 32, 34, 36 and 38. The plate 30 is preferably made of the same material as the support beams including steel, coated steel, heat treated steel and combinations thereof. The plate is at least 1 inch thick and has a stiffness which prevents deformation upon impact of the traveling block with the bumper pad.

The plate 30 can be welded to the support beams or bolted. If bolts are used, it is preferred that the bolts be 1 inch OD and 14 inch in length. Nuts may be used with the bolts as well, and are identified in FIG. 3 as 52, 54, 56 and 58, respectively. Riveting is also a fastening means that is contemplated as within the scope of the invention for securing the plate to the support beams. The plate can be made from a member of the group, steel, coated steel, heat-treated steel and combinations thereof, or any other high strength, low temperature rated metal.

Bumper pad 40 is shown secured to the plate 30 with the same fasteners 32, 34, 36 and 38. The fasteners can also be pins, or clips. The bumper pad is preferably a multi- layer, laminate structure, wherein the high impact material is layered on the side closest to the plate, and the low impact material is layered further from the plate.

Figure 3:
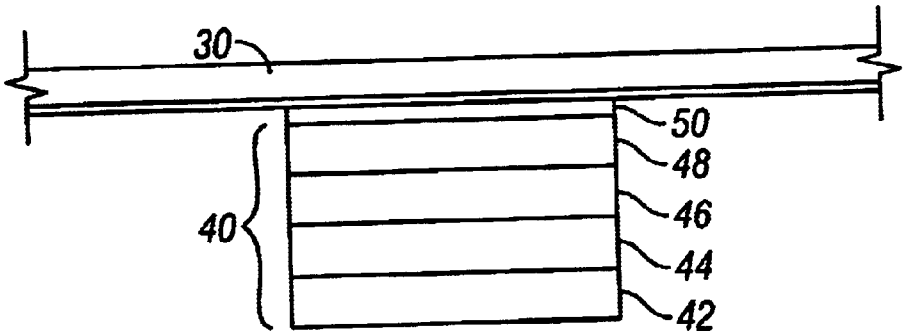
FIG. 3 is a side view of the bumper pad secured to the plate according to one embodiment of the invention.

In the most preferred embodiment, shown in FIG. 3, the bumper pad is a five layer laminate, having layer 42 of natural rubber, layer 44 of butyl, layer 46 of an additional butyl, layer 48 of a third butyl and layer 50 of a fourth butyl. The butyl layers can be identical butyls or different butyl layers.

In the preferred commercial embodiment, the bumper pad is made from several layers of rubber, which range from natural rubber, having high resistance to ultraviolet ray degradation and a high durometer, to a low duromoter butyl material. In constructing the laminate, the highest durometer material is positioned on the side adjacent the plate.

The pad can also be made, in part of elastomeric material such as nitrile. It is contemplated that the bumper pad can be a laminate wherein the high durometer materials is a high quality butyl, a halogenated butyl elastomer and combinations thereof, such as the blends made by the JM Clipper Corporation.

It is also contemplated that the bumper pad laminate may have one or more components, which can include natural rubber, synthetic rubber, polymers, copolymers, cross-linked polymers, elastomers and combinations of these.

The bumper pad, plate and support combination are expected to withstand an impact of at least 120,000 pounds at normal post braking velocities for the traveling block.

Returning to FIG. 2, bumper pad 40 is most preferably square or alternatively of a rectangular shape and has a preferred dimension of 20 inches long by 20 inches wide and 12 inches high. The bumper pad can range in size between 8 and 48 inches long, between 10 and 48 inches wide, and 6 and 24 inches high. The preferred "height" or thickness of the pad is 12 inches.

The bumper pad may be of any shape that is sufficient to absorb impact with the traveling block.

Figure 4:
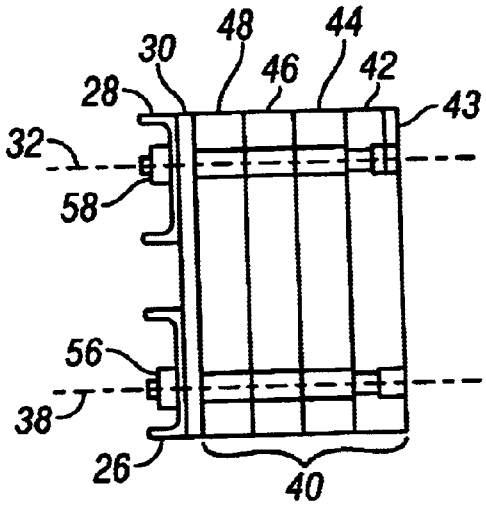
FIG. 4 is cross sectional view of crown bumper.

FIG. 4 shows bolts 38 and 32 with nuts 56 and 58 respectively securing the bumper pad 40 to plate 30. It is preferred that the head of the bolts be recessed into the outer layer 42 of the bumper pad 40 to prevent contacting or impact with the cables 18.

In an alternative embodiment, a pin 43, such as a cotter pin, can be disposed through the rubber of the bumper pad, across the bolt, so that if the bolt brakes, the pin stops the bolt pieces from coming out, and enables easier maintenance. A roll pin instead of a cotter pin can also be used within the scope of the invention for the pin 43.

In addition to the safety device and crown bumper described above, the present inventions relates to an oil drilling rig apparatus, comprising: a derrick having a lower end for mounting on a platform, an upwardly projecting frame, and an upper, crown end; a traveling block suspended from the upper crown end within the derrick frame; drive means linked to the traveling block for driving the traveling block up and down the frame in a predetermined travel path; and a crown bumper comprising: at least two support beams attached to the derrick; a plate secured between said support beams; a bumper pad secured to the plate and adapted to be positioned at the crown end of the derrick to cushion any impact with the traveling block if it is pulled to the crown end without stopping. The same variations to the crown bumpers described above apply to the crown bumper used on the oil derrick The invention relates to the specific crown bumper as described.

Finally, the invention relates to a method of preventing damage to the crown of a derrick prior to impact of a traveling block with the crown end of the derrick, comprising the steps of:

a. securing a crown bumper at a location spaced below the crown end in a travel path of the traveling block at that location comprising support beams secured to said crown end, a plate secured to said support beams and a bumper pad secured to said plate;

b. driving the traveling block up the derrick until just before it contacts the bumper pad; and c. engaging the brakes of the traveling block just before the traveling block hits the bumper pad.

Although a preferred embodiment of the invention has been described above by way of example only, it will be understood by those skilled in the field that modifications may be made to the disclosed embodiment without departing from the scope of the invention, which is defined by the appended claims.

What is claimed is:

1. A safety apparatus for a derrick having a crown and at least one traveling block, comprising:

a. at least two support beams attached to the crown of a lifting structure;

b. a plate secured between said support beams;

c. a dual compound bumper pad for shock absorption and impact resistance consisting of a high quality natural rubber and a member of the group consisting of a high quality butyl, a halogenated butyl elastomer, and combinations thereof, secured to said plate overlaying the edges of the plate and adapted to be positioned at the crown of the derrick to cushion any impact between the traveling block and the crown and to eliminate the possibility to cutting any ropes used by the traveling block, if the traveling block is lifted towards the crown without stopping;

d. wherein said bumper pad is secured to said plate with fasteners and the bumper pad has a length of between 8 inches and 48 inches and a width of between 10 inches and 48 inches, and a height between 6 and 24 inches; and e. wherein the plate is at least 1 inch thick and said plate and said support beams comprise a material selected from the group consisting of steel, coated steel, heat treated steel, and combinations thereof.

2. The apparatus as claimed in claim 1, wherein the fasteners are bolts.

3. The apparatus as claimed in claim 2, wherein the support beams have a thickness of at least 1 inch and a width of at least 2 inches, and a length of between 30 to 60 inches.

4. The apparatus as claimed in claim 3, comprising two support beams made from structural steel, each support beam having a length of 58 inches, width of 3 inches and thickness of 1 inch.

5. The apparatus as claimed in claim 1, wherein the bumper pad is a laminate having components selected from the group: rubber, synthetic rubber, polymer, copolymer, elastomer, and combinations thereof.

6. The apparatus as claimed in claim 5, wherein the bumper pad is made from an ultraviolet ray resistant material.

7. The apparatus as claimed in claim 1, wherein the bumper pad consists of a high durometer rubber adhered to a low duromoter rubber, and wherein the high durometer rubber is positioned on the side adjacent the plate.

8. The apparatus as in claim 1, wherein said bumper pad has a thickness of at least 12 inches.

9. The apparatus as claimed in claim 8, wherein the bumper pad is approximately 20 inches long and 20 inches wide and 12 inches high.

10. An oil drilling rig apparatus, comprising:

a. a derrick having a lower end for mounting on a platform, an upwardly projecting frame, and an upper crown end;

b. a traveling block suspended from the upper crown end within the projecting frame;

c. drive means linked to the traveling block for driving the traveling block up and down the projecting frame in a predetermined travel-path; and d. a crown bumper comprising:

i. at least two support beams attached to the derrick;

ii. a plate secured between said support beams;

iii. a dual compound bumper pad for shock absorption and impact resistance consisting of a high quality natural rubber and a member of the group consisting of a high quality butyl, a halogenated butyl elastomer, and combinations thereof, secured to said plate overlaying the edges of the plate and adapted to be positioned at the crown of the derrick to cushion any impact between the traveling block and the crown and to eliminate the possibility to cutting any ropes used by the traveling block, if the traveling block is lifted towards the crown without stopping;

iv. wherein said bumper pad is secured to said plate with fasteners and the bumper pad has a length of between 8 inches and 48 inches and a width of between 10 inches and 48 inches, and a height between 6 and 24 inches; and v. wherein the plate is at least 1 inch thick and said plate and said support beams comprise a material selected from the group consisting of steel, coated steel, heat treated steel, and combinations thereof.

11. The oil drilling rig apparatus, as claimed in claim 10, wherein said crown bumper support beams and plate comprise a high strength, low temperature rated metal.

12. The oil drilling rig apparatus, as claimed in claim 11, wherein the metal is steel.

13. The oil drilling rig apparatus, as claimed in claim 12, wherein the fasteners are bolts.

14. The oil drilling rig apparatus, as claimed in claim 10, wherein the support beams have a thickness of at least 1 inch and a width of at least 2 inches, and a length of between 30 to 60 inches.

15. The oil drilling rig apparatus, as claimed in claim 14, comprising two support beams made structural steel, each support beam having a length of 58 inches, width of 3 inches and thickness of 1 inch.

16. The oil drilling rig apparatus, as claimed in claim 10, wherein the bumper pad is a laminate having components selected from the group: rubber, synthetic rubber, polymer, copolymer, elastomer, and combinations thereof.

17. The oil drilling rig apparatus, as claimed in claim 16, wherein the bumper pad is made from an ultraviolet ray resistant material.

18. The oil drilling rig apparatus, as claimed in claim 10, wherein the bumper pad laminate consists of a high durometer rubber adhered to a low duromoter rubber, and wherein the high durometer rubber is positioned on the side adjacent the plate.

19. The oil drilling rig apparatus, as in claim 10, wherein said bumper pad has a thickness of 12 inches.

20. The oil drilling rig apparatus, as claimed in claim 19, wherein the bumper pad is approximately 20" long and 20" wide and 12 inches high.

21. A crown bumper for an lifting tower comprising:

a. at least two support beams attached to the hoist unit;

b. a plate secured between said beams; and c. a dual compound bumper-pad for shock absorption and impact resistance consisting of a high quality natural rubber and a member of the group consisting of a high quality butyl, a halogenated butyl elastomer, and combinations thereof, secured to said plate overlaying the edges of the plate and adapted to be positioned at the crown of the derrick to cushion any impact between the traveling block and the crown and to eliminate the possibility to cutting any ropes used by the traveling block, if the traveling block is lifted towards the crown without stopping;

d. wherein said bumper pad is secured to said plate with fasteners and the bumper pad has a length of between 8 inches and 48 inches and a width of between 10 inches and 48 inches, and a height between 6 and 12 inches; and e. wherein the plate is at least 1 inch thick and said plate and said support beams comprise a material selected from the group consisting of steel, coated steel, heat treated steel, and combinations thereof.

22. The crown bumper as claimed in claim 21, wherein the fasteners are bolts.

23. The crown bumper as claimed in claim 21, wherein the support beams have a thickness of at least 1 inch and a width of at least 2 inches, and a length of between 30 to 60 inches.

24. The crown bumper as claimed in claim 23, comprising two support beams made structural steel, each support beam having a length of 58 inches, width of 3 inches and thickness of 1 inch.

25. The crown bumper as claimed in claim 21, wherein the bumper pad is a laminate having components selected from the group: rubber, synthetic rubber, polymer, copolymer, elastomer, and combinations thereof.

26. The crown bumper as claimed in claim 25, wherein the bumper pad is made from an ultraviolet ray resistant material.

27. The crown bumper as claimed in claim 21, wherein the bumper pad consists of a high durometer rubber adhered to a low duromoter rubber, and wherein the high durometer rubber is positioned on the side adjacent the plate.

28. The crown bumper as in claim 21, wherein said bumper pad has a thickness of 12 inches.

29. The crown bumper as claimed in claim 28, wherein the bumper pad is approximately 20" long and 20" wide and 12 inches high.

30. The crown bumper as claimed in claim 21, further comprising a pin disposed through said bumper and across said fastener to prevent broken fasteners from falling out of the bumper pad.

31. A method of preventing damage to the crown of an oil drilling derrick prior to impact of a traveling block with a crown end, comprising the steps of:

a. securing a crown bumper at a location spaced below the crown end in a travel path of the traveling block comprising support beams secured to said crown end, a plate secured to said support beams and a bumper pad secured to said plate;

b. driving the traveling block up the derrick until just before it contacts the bumper pad; and c. then apply the brakes of the traveling block.

* * * * *